US009050820B2

(12) United States Patent
Soleimani-Gorgani

(10) Patent No.: US 9,050,820 B2
(45) Date of Patent: Jun. 9, 2015

(54) THREE-DIMENSIONAL INK-JET PRINTING BY HOME AND OFFICE INK-JET PRINTER

(71) Applicant: Atasheh Soleimani-Gorgani, Tehran (IR)

(72) Inventor: Atasheh Soleimani-Gorgani, Tehran (IR)

( * ) Notice: Subject to any disclaimer, the term of this patent is extended or adjusted under 35 U.S.C. 154(b) by 100 days.

(21) Appl. No.: 13/730,913

(22) Filed: Dec. 29, 2012

(65) Prior Publication Data

US 2014/0184673 A1 Jul. 3, 2014

(51) Int. Cl.

| | |
|---|---|
| ***B41J 2/21*** | (2006.01) |
| ***B41J 3/32*** | (2006.01) |
| ***B41J 11/00*** | (2006.01) |

(52) U.S. Cl.

CPC *B41J 2/2114* (2013.01); *B41J 3/32* (2013.01); *B41J 11/002* (2013.01)

(58) Field of Classification Search

CPC ..... B41J 2/447; B41J 2/215; B41J 2/475
USPC ..... 347/12, 15, 95, 96, 100
See application file for complete search history.

(56) References Cited

U.S. PATENT DOCUMENTS

| | | | | |
|---|---|---|---|---|
| 4,855,752 | A * | 8/1989 | Bergstedt | 347/41 |
| 4,966,828 | A | 10/1990 | Doenges et al. | |
| 5,140,937 | A | 8/1992 | Yamane et al. | |
| 5,204,055 | A | 4/1993 | Sachs et al. | |
| 5,340,656 | A | 8/1994 | Sachs et al. | |
| 5,387,380 | A | 2/1995 | Cima et al. | |
| 5,397,673 | A | 3/1995 | Watson et al. | |
| 5,627,578 | A | 5/1997 | Weintraub | |
| 5,807,437 | A | 9/1998 | Sachs et al. | |
| 6,036,777 | A | 3/2000 | Sachs | |
| 6,084,604 | A * | 7/2000 | Moriyama et al. | 347/15 |
| 6,331,290 | B1 | 12/2001 | Morgan | |
| 6,375,874 | B1 | 4/2002 | Russell et al. | |
| 6,402,403 | B1 | 6/2002 | Speakman | |
| 6,644,763 | B1 | 11/2003 | Gothait | |
| 7,416,764 | B2 | 8/2008 | Matsumoto et al. | |
| 7,550,518 | B2 | 6/2009 | Bredt et al. | |
| 8,016,409 | B2 * | 9/2011 | Silverbrook | 347/102 |
| 2008/0218540 | A1 | 9/2008 | Iftime et al. | |
| 2011/0218266 | A1 | 9/2011 | Studer et al. | |

* cited by examiner

*Primary Examiner* — Lamson Nguyen
(74) *Attorney, Agent, or Firm* — Azadeh Saidi

(57) ABSTRACT

A new method for printing raised letters or images has been introduced, which is inexpensive, green and noiseless. The method can be carried out via personal computers (PC) or common ink-jet printers. A standard portable ink-jet printer is controlled by PC and common graphical softwares, that provide raised printing for different purposes such as Braille prints, security, packaging, advertising and printing of warning signs. The 3D ink-jet printing method comprises steps of providing two or more fluids having different formulation as inks. The mixture is cured and raised by jetting two inks in a controlled amount and mixing of inks on the substrate, without using electromagnetic radiation such as ultra violet (UV) or infra red (IR) or heating procedure. The prepared inks are water based, non-toxic, environmental friendly and have different compositions with optimum physical.

19 Claims, 4 Drawing Sheets

THREE-DIMENSIONAL INK-JET PRINTING BY HOME AND OFFICE INK-JET PRINTER

BACKGROUND OF THE INVENTION

Ink-jet printing technology has been developed for many years and in the last two decades ink-jet printing, especially drop-on demand (DOD) ink-jet printing systems have grown to a major topic in scientific research. DOD ink-jet printers are widely used in small businesses and home offices due to their low price, low noise, easiness of full colouration, low space demand, environmental safety, and being able to print various substrates including plain papers, papers for special printing and transparency.

Ink-jet printing is a non-contact method in which droplet of inks are directly projected on to a substrate from very fine nozzles and allowed to adhere to the substrate forming characters and images. The two most popular types of DOD ink-jet printers are thermal and piezoelectric. Compared to conventional manufacturing method ink-jet printing can be carried out in low temperatures. Furthermore, chemical waste can be significantly reduced because ink-jet printers can print only on the desired location without unnecessary post-processing that can damage the actual substrate and material.

Ink-jet printing has become widespread to the point that personal computers readily permit the users to create high grade prints and publishing with various controllable fonts and point sizes, as well as with the ability to print graphics either locally generated or from pre-packaged clip art.

In the past several years, there has been considerable interest in developing computerized, three dimensional printing techniques. Three-dimensional printing is a method of creating three-dimensional objects by depositing or forming thin layers of material in succession so as to build up the desired three dimensional structures. The printers are not however capable of anything other than normal flat printing. Accordingly higher scale stationery, such as business cards and letterhead papers, require raised lettering. Therefore various methods have been devised to create raised letter or image.

In one of the methods, the ink used to provide the wet substrate for the thermo-graphic process, is preferably formulated from the standard inks used in ink-jet printers. Many of the ink-jet printers are designed for operation with water based inks (to prevent clogging) and accordingly a thermo-graphic powder which will adhere thereto is preferably used. The inked paper is then subjected to a dusting with a thermo-graphic powder, formulated to adhere only to the inked portion of the paper, with excess powder being removed from the paper and recycled. Thermo-graphic activation heat (about 132-148° C.) is then used to cause the adhered powder and ink to rise to form the raised text or graphics.

With the current state of thermo-graphy it is not possible to print with alternate sites of raised and non raised lettering and/or graphics in a single pass. Instead two passes are required, one for the flat printing and one for the raised printing, with attendant problems of alignment and proper registrations.

Another technique makes use of a bath of polymerisable liquid material. A thin upper layer of the liquid is cross-linked or hardened in some way, such as electromagnetic radiation (UV, IR), in a pattern which is the same as cross-section through the object to be formed. The electromagnetic radiation spot is moved across the surface in accordance with a digital representation of the relevant cross-section. After one layer is complete the liquid level is raised over a small distance and the process repeated. Each polymerized layer should be sufficiently formed stable to support the next layer.

Another process uses an ink-jet printing technique wherein an ink-jet stream of liquid molten metal or a metal composite material is used to create three-dimensional objects under computer control, similar to the way an ink-jet printer produces two dimensional graphic printing. A metal or metal composite part is produced by ink-jet printing of successive cross sections, one layer after another on a target, using a cold welding (rapid solidification) technique, which causes bonding between the particles and the successive layers.

A second type of printing requiring raised characters is that of Braille printing, which is a representation of alphabetic letters via raised dots (up to six dots/character) in varying configurations. These dots or characters, which are read by finger touch, must be of a minimal standard height for touch sensitive reading by the blind. Currently, the various means for Braille printing are either very labor intensive, or requires expensive machinery and processing. One known method is to use impact printer to emboss paper with raised portions representing the Braille characters. Thus, Braille printing has been affected by using a Braille typewriter which impresses dots on a heavy stock paper or cardboard, such that the dots are raised on the other side of the stock.

Compared with conventional printers, the impact printers can be expensive due to their complexity, noisy due to the constant impacting of the printer and unreliable due to the high forces on the moving parts. Recently, machines have been developed for printing of Braille and other raised lettering and graphics in a thermo-graphic process. These machines, however represent sophisticated technology and are very expensive and accordingly not agreeable for use in common desktop publishing applications. Even with the sophistication of the machines, simultaneous printing of raised and non-raised portions is still not possible, such as the printing of regular text with corresponding clear raised Braille print thereon.

It is therefore an object of the present invention to provide a low cost system for producing raised lettering and graphics in desk top publishing applications. It is a further object of the present invention to produce such raised lettering and graphics by means of a personal computer and an ink-jet type printer.

With appropriate conversion software relative to any language and any Braille language it is possible to simultaneously print the underlying language and the Braille print. A monitor display shows the print field prior to initial printing for desired changes prior to printing. With text scanners being widely and economically available, it is also possible to scan regular typed or printed text and graphics into a computer. With the appropriate conversion software, the scanned text is converted to Braille and is nearly simultaneously printed out in raised Braille print, all without any labor intensive text entry.

SUMMARY OF THE INVENTION

The present invention's object is accurate and fast formation of 3D features onto a substrate. Furthermore this method is able to print raised and non-raised portions simultaneously. The raised and non-raised printed images can be either colourfull or colourless.

In this invention a new method for printing raised letters or images is introduced, which is inexpensive, green, nano structured and noiseless via personal computers or common ink-jet printers. In this method a standard portable ink-jet printer controlled by personal computer and common graphical software, provides raised printing for different purposes. The 3D ink-jet printing method comprises the steps of providing two or more fluids having a different formulation as inks for ink-jet printers. Then by jetting two inks in a controlled amount and mixing of inks on the substrate, the mixture is cured and raised without using of electromagnetic radiation (UV, IR) or heating procedures. The prepared inks are water based, non-toxic, environmental friendly and have different compositions with optimum physical properties (viscosity, pH, and surface tension).

One of the most important applications of raised characters is Braille printing which is a representation of alphabetic letters by raised dots (up to six dots/character) in varying configurations that are readable by finger touch of a blind. The various means for Braille printing are either labor intensive or require expensive machinery and processing. It is therefore an object of the present invention to provide a low cost system for producing raised Braille print. This invention is also applicable in raised printing for security, packaging, advertising purposes as well as printing of warning signs with the use of personal computers, ordinary graphical software and common ink-jet printers.

DETAILED DESCRIPTION

Ink-jet printing technology has been developed for many years and in the last two decades ink-jet printing; especially drop-on demand (DOD) ink-jet printing system has grown to a major topic in scientific research. DOD ink-jet printers are widely used in small business and home offices due to their low price, low noise, easiness of full colouration, low space demand, and being able to print various substrates including plain paper, paper for special printing and transparency.

Ink-jet printing is a non-contact method in which droplets of inks are directly projected on to a substrate from very fine nozzles and allowed to adhere to the substrate form characters and image. The two most popular types of DOD ink-jet printers are thermal and piezoelectric. In DOD ink-jet printer suddenly raises the pressure on the ink, ejecting it from the nozzle either by the selective evaporation of ink produced by the physical phenomenon of electrostriction a change in dimension, in response to an applied electric field.

In the thermal ink-jet printer, the ink droplets are sputtered by the pressure brought about by the selective evaporation of ink that results from heating a thermocouple integrated in the ink channel of the nozzle. In the piezo ink-jet printer, a very small dimensional change of piezoelectric material is harnessed over a large area to generate a volume change that is large enough to squeeze out a drop of ink from a small chamber.

The ink-jet printer is a DOD ink-jet printing system either by having a piezoelectric print head (Epson Stylus Photo P50) or thermal print head (HP DeskJet 5150 printer) for delivering ink-jet ink droplets to a substrate. The ink supply system is connected to a computer for controlling the ink mixing process. This may include the control of each ink amount to obtain desired ink mixture. The substrate, method of printing, ink lay down, and handling of printed specimens shall be consistent with the anticipated end use of the specimens.

Figure 1:
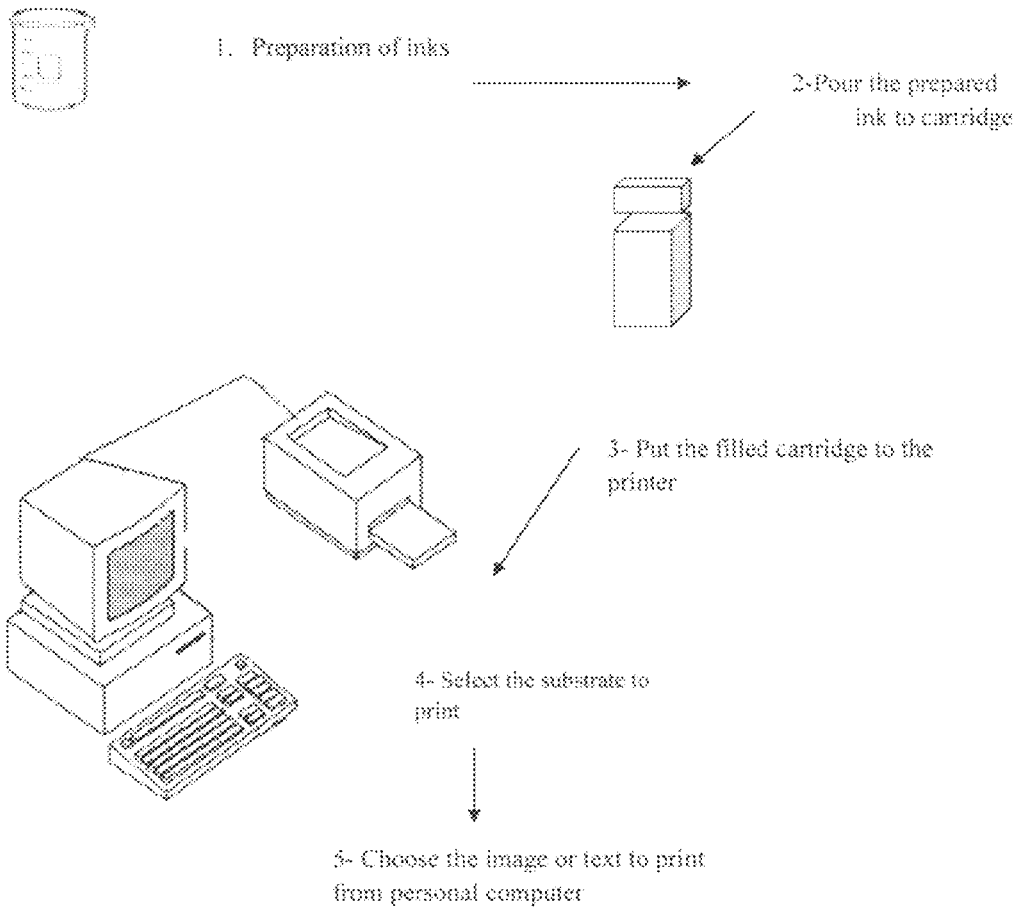
FIG. 1; is a schematic view of the method carried out by the computer.
Figure 2:
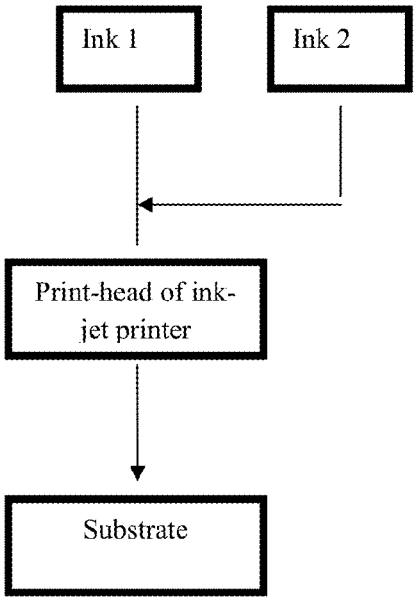
FIG. 2; is an example of possible constructions for mixing the ink-jet jet inks in the ink-jet jet printer.

The printed image may be generated with any word processing tools, drawing/graphics, or page layout software, saved as a print file for each printing. FIG. 1 shows a schematic of the 3D ink-jet printing method.

Substrates such as glass, polyethylene terephthalate (PET), plastic, metal, plain paper, coated paper, card and polyimide may be used in the present invention.

Despite all the advantages of current ink-jet printing technology, nozzle clogging has been the biggest problem of all ink-jet printers. This is because the inks used for ink-jet printing may contain insoluble particles that can be precipitated during the printing process. In this invention, an ink-jet printing method that potentially solves the nozzle clogging problem is introduced.

The 3D ink-jet printing method comprises the steps of providing two or more water soluble fluids having a different formulation as inks for ink-jet printers. The 3D ink-jet printings can form in two steps process via chemical reaction between two reactive ink drops:

1. Two reactive drops from different inks with a variety of concentrations from various ink-jet printer cartridges can react by jetting in a controlled amount and mixing of inks on the substrate. The mixture is cured and raised without using of electromagnetic radiation (UV, IR) or heating procedure.
2. In another method, firstly one reactive ink from ink-jet printer cartridge is jetted in a controlled amount to produce a pattern, and then the second reactive ink from ink-jet printer cartridge is jetted on previous printed layer. The printed pattern is cured and raised without using of electromagnetic radiation (UV, IR) or heating procedure.

In both processs, the nano particle were produced by forming the raised (3D) pattern or image simultaneously.

In the above mentioned methods, in order to gain optimum raising image, after one layer is complete the printing run can be repeated. By increasing the number of printing runs, the height of 3D printed pattern or image will be increased.

The prepared inks are water based, non-toxic, environmental friendly, stable and having a different composition with optimum physical properties (viscosity, pH, and surface tension). The different formulation of inks can effect:

a) Image quality of printed subject, (dote size, gloss, line quality and bleeding);

b) Physical properties of inks (viscosity, shelf-life, surface tension, drying time, adhesion to substrate, stability, and 3) Jetting performance of the printer (drop formation, satellite formation, latency, nozzles clogging).

Ink-jet jet inks are substantially colourless liquids, but in a preferred embodiment of the 3D ink-jet jet printing method, one of the two ink-jet jet inks comprises a colourant, which is generally only present for aesthetical reasons. Colourants used in the ink-jet inks can be dyes or pigments or a combination thereof. Generally pigments are stabilized in the dispersion medium by dispersing agent, such as polymeric dispersant or surfactant. However the surface of the pigments can be modified to obtain self-dispersible pigments. If the colourant is not a self-dispersible pigment, the pigmented ink-jet ink may contain at least one dispersion agent. A mixture of dispersion agents may be used to further improve dispersion stability. Pigment particles in ink-jet inks should be sufficiently small (between 0.070 to 0.2 μm) to permit free flow of the ink through the nozzles of ink-jet jet printing. It is also desirable to use small particles for maximum colour strength and to slow down sedimentation. Dyes suitable for ink-jet jet ink include direct dyes, acidic dyes, basic dyes and reactive dyes. In this 3D ink-jet printing, colour inkjet inks (Cyan, Magenta, Yellow and Black) may used to give different areas of the 3D-object a different colour.

The viscosity of the ink-jet ink is less than 50 centipoises (CPs), preferably in the range of 1 to 40 Cps at room temperature, more preferably in the range of 1.9 to 35 Cps, which is dependent on the type of DOD ink-jet printer.

The surface tension of the ink-jet ink is less than 60 milliNewtons per meter (mN/m), preferably in the range of 20 to 50 mN/m at room temperature, more preferably in the range of 30 to 45 mN/m, which is dependent on the type of DOD ink-jet printer and the surface energy of the substrate.

The water based inks comprise of de-ionised water as solvent, the water content of the ink is preferably 40% or more by weight of the total weight of the ink in order to maintain the ink at low viscosity which is applicable to any type of the ink-jet printer and reduces changes in viscosity with temperature. The content of the water in the ink is from 20 to 84% and preferably form 40 to 80% and more preferably 69 to 79% by weight of the total weight of ink.

The ink composition may further comprise optional water-soluble organic solvent as humectants. The water-soluble organic solvent used in the first embodiment is preferably a low volatile solvent because this solvent is mainly used to prevent the ink from being deposited or hardened at the tip of the print head to reduce changes in viscosity with temperature, it is more preferable to select a highly polar solvent which has a relatively small molecular weight that dissolves dye well. Examples of such are Polyalkylene glycol having a mean molecular weight of 400 or less, such as polyethylene glycole; Alkylene glycols such as ethylene glycol, propylene glycol, butylene glycol, diethylene glycol, dipropylene glycol, triethylene glycol, tripropylene glycol, 1,2,6 hexanetriol, thiodiglycol, 1,3 butanediol, 1,5 pentanediol, hexylene glycol, glycerine, pyrrolidine, 2-pyrrolidone, N-methyl-2-pyrrolydone. The content of the water-soluble organic solvent in the ink is from 7 to 40% and preferably form 10 to 30% and more preferably 2 to 10% by weight of the total weight of ink.

Figure 3:
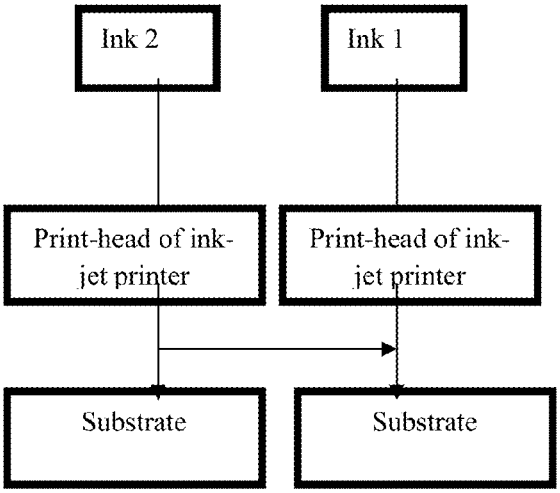
FIG. 3; is an examples of possible constructions for mixing the ink-jet jet inks in the ink-jet jet printer.

The ink formulation may further comprise colourant (water soluble dye or pigment). Use of Water soluble dye is displayed in FIG. 3, it is advantageous to use cationic and anionic dyes, such as basic dyes, acid dyes, direct dyes, and reactive dyes. In addition, a mixture of two or more kinds of dyes can be used as the water soluble dye, the content of the water soluble dye varies over a wide range depending on the desired colour and density 0.1 to 5% by weight of the total weight of the ink.

The ink-jet ink composition also includes a pigment. The pigments may be non-ionic, cationic, anionic, and/or combinations thereof. The content of the pigment in the ink is from 0.1 to 20% and preferably form 1 to 15% and more preferably 1 to 6% by weight of the total weight of ink.

In addition the ink composition may further comprise optional co-solvent penetrants or fixing agents (ester or resin drying agent), it is advantage to use polyalcoholmonoalkyether with a vapour pressure of 0.1 mmHg or less at 20° C. Polyalcohol monoalkylethers effectively speeds up ink penetration into the paper, dries the ink on the paper more quickly, and prevents breeding due to slowly dried ink as well as feathering developement upon ink penetration. Monoatomic alcohols such as ethanol and isopropyl alcohol may be used to control the ink penetration into the paper and the ink drying characteristic. The content of penetrants in the ink is from 0 to 15% and preferably form 2 to 15% and more preferably 3 to 15% by weight of the total weight of ink.

The ink-jet ink formulation also includes reactive materials, which are based on metal sulphates, metal phosphates, metal acetate, metal citrate, and metal chlorides. The content of the reactive material in the ink is more than 5%, preferably from 5 to 25% and more preferably form 10 to 25% by weight of the total weight of ink.

The ink-jet ink may include binders. The binder may be any polymeric material which assists in binding the pigment to a substrate after the liquid components of the ink have been absorbed into and or evaporated from a printed image, celluloses waxes, polyamide, polyester, polyurethane and especially poly vinyl polymers such as polyvinyl butyral, poly vinyl chloride, vinyl chloride-vinyl acetate preferably a meth acrylate polymer, polyester, polyethylene dioxide and copolymer of the monomer. Further binders may include natural materials or processed natural materials for example gelatin, methyl cellulose, cellulose ether. The binder must be selected in a way that it contains good solubility in the solvent. The amount of the binder in ink-jet ink is preferably in the range of 1 to 20% wt, most preferable 1 to 10% wt based on the total weight of the ink-jet ink.

The ink-jet inks may include other additives such as a dispersant, a surface active agent, a viscosity modifier, a surface tension modifier, buffering agents, anti-mold agents, pH adjustment agent, anti rusting agent, light stabilizers.

Suitable pH adjusters include, Triethylamine, triethanolamine, NaOH, KOH, acetic acid, disodium hydrogen phosphate, HCl. The water based inks should be prepared in pH=7 to 7.5.

The application of this invention is wide. One of the most important applications of raised characters is Braille printing which is representation of alphabetic letters by raised dots (up to six dots/character) in varying configurations that are readable by finger touch of blind. The various means for Braille printing are either labor intensive or require expensive machinery and processing. It is therefore an object to the present invention to provide a low cost system for producing raised Braille print. This invention is also applicable in raised printing for security, packaging, advertising purposes, printing of warning signs, wall-paper, electronic, medical and ceramic with the use of personal computers, ordinary graphical software and common ink-jet printers.

Figure 4:
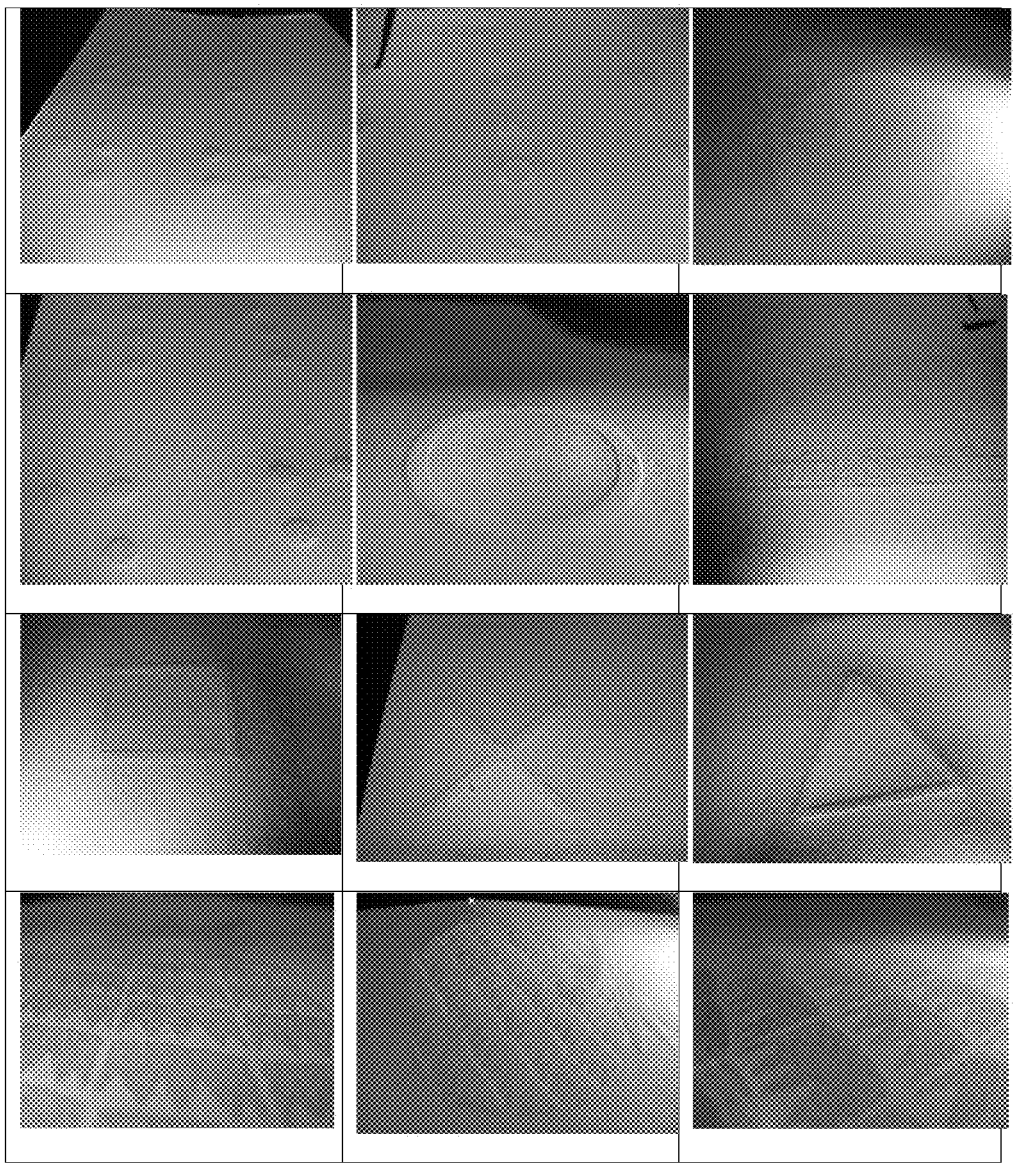
FIG. 4; displays examples of the fast formation of 3D features on a substrate.

Another object of this invention is accurate and fast formation of 3D features onto a substrate; as displayed in FIG. 4. Furthermore this method is able to print raised and non-raised portions simultaneously. The raised and non-raised printed image can be either colourfull or colourless or combination thereof.

Inks preparation and printing of prepared inks to produce three-dimensional printing is better explained in the examples below. These examples illustrate how the 3D printing can be varied by using mixtures of two ink-jet ink differing in composition

EXAMPLE 1

Figure 5:
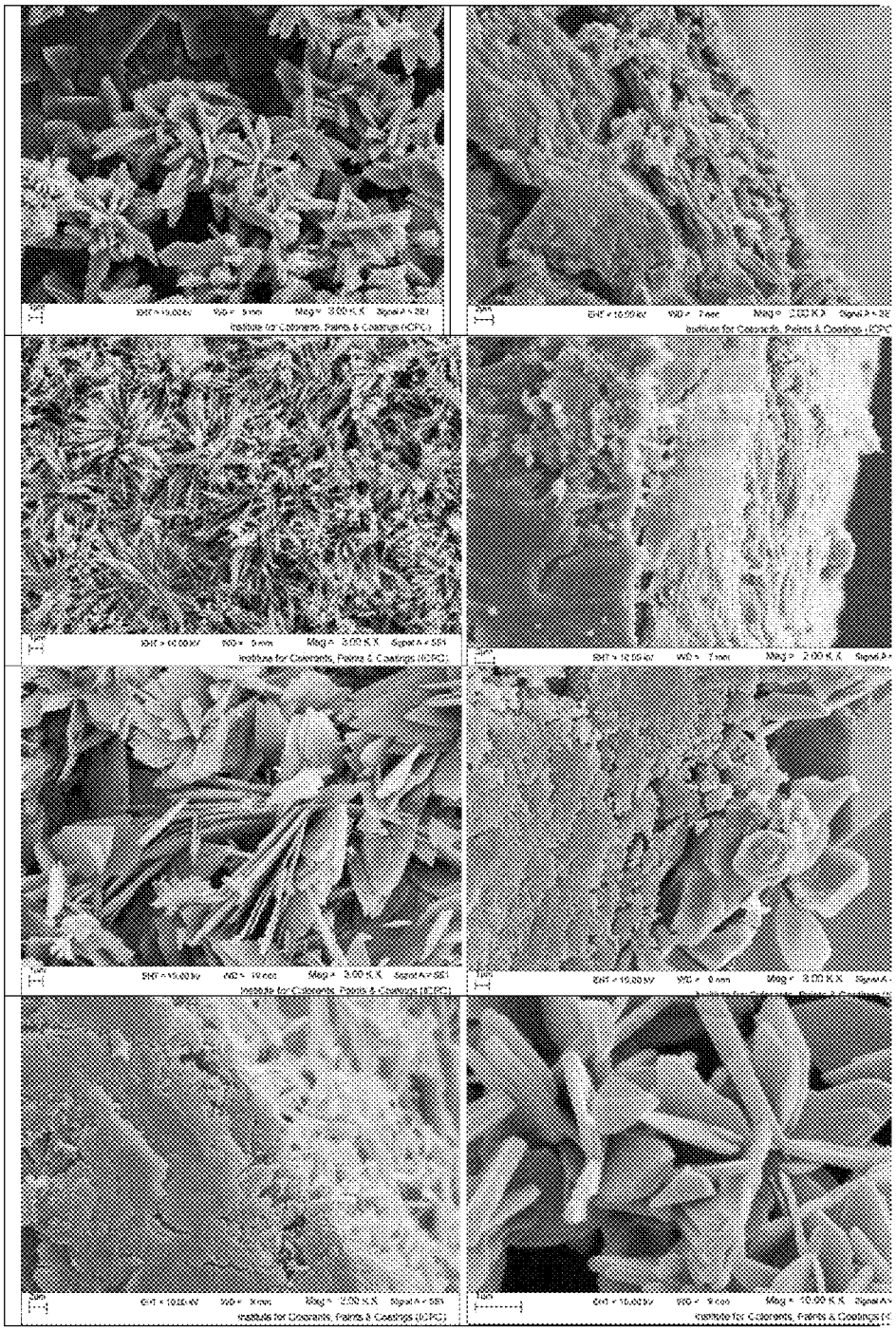
FIG. 5; displays SEM analysis of the printed substrate and nano-particles production.

Ink1 and Ink3 were prepared according to Table 1, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved (FIG. 5) and nano-particles were produced.

TABLE 1

| Formulation of Ink 1 and Ink 3 | | |
|---|---|---|
| Wt % | Ink1 | Ink 3 |
| Water | 73 | 70 |
| Humectants | 0.74 | 0.69 |
| Binder | 2.21 | 2.1 |
| Co-solvent | 9.2 | 8.6 |
| Reactive material | 14 | 19.1 |

EXAMPLE 2

Ink1 and Ink4 were prepared according to Table 2, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 2

| Formulation of Ink 1 and Ink 4 | | |
|---|---|---|
| Wt % | Ink 1 | Ink 4 |
| Water | 73 | 71.8 |
| Humectants | 0.74 | 0.71 |
| Binder | 2.21 | 2.1 |
| Co-solvent | 9.2 | 8.98 |
| Reactive material | 14 | 16.2 |

EXAMPLE 3

Ink1 and Ink5 were prepared according to Table 3, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 3

| Formulation of Ink 1 and Ink 5 | | |
|---|---|---|
| Wt % | Ink1 | Ink 5 |
| Water | 73 | 73.2 |
| Humectants | 0.74 | 0.73 |
| Binder | 2.21 | 2.2 |
| Co-solvent | 9.2 | 9.15 |
| Reactive material | 14 | 14.65 |

EXAMPLE 4

Ink1 and Ink6 were prepared according to Table 4, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 4

| Formulation of Ink 1 and Ink 6 | | |
|---|---|---|
| Wt % | Ink1 | Ink 6 |
| Water | 73 | 68 |
| Humectants | 0.74 | 0.68 |
| Binder | 2.21 | 2.04 |
| Co-solvent | 9.2 | 8.53 |
| Reactive material | 14 | 20.47 |

EXAMPLE 5

Ink2 and Ink3 were prepared according to Table 5, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 5

| Formulation of Ink 2 and Ink 3 | | |
|---|---|---|
| Wt % | Ink 2 | Ink 3 |
| Water | 70.7 | 70 |
| Humectants | 0.7 | 0.69 |
| Binder | 2.12 | 2.1 |
| Co-solvent | 8.83 | 8.6 |
| Reactive material | 17.66 | 19.1 |

EXAMPLE 6

Ink2 and Ink4 were prepared according to Table 6, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 6

| Formulation of Ink 2 and Ink 4 | | |
|---|---|---|
| Wt % | Ink 2 | Ink 4 |
| Water | 70.7 | 71.8 |
| Humectants | 0.7 | 0.71 |
| Binder | 2.12 | 2.1 |

TABLE 6-continued

| Formulation of Ink 2 and Ink 4 | | |
|---|---|---|
| Wt % | Ink 2 | Ink 4 |
| Co-solvent | 8.83 | 8.98 |
| Reactive material | 17.66 | 16.2 |

EXAMPLE 7

Ink2 and Ink5 were prepared according to Table 7, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 7

| Formulation of Ink 2 and Ink 5 | | |
|---|---|---|
| Wt % | Ink 2 | Ink 5 |
| Water | 70.7 | 73.2 |
| Humectants | 0.7 | 0.73 |
| Binder | 2.12 | 2.2 |
| Co-solvent | 8.83 | 9.15 |
| Reactive material | 17.66 | 14.65 |

EXAMPLE 8

Ink 2 and Ink 6 were prepared according to Table 8, the percentage are weight percentage based upon the total weight of the mixture. Then, the prepared Inks poured in separate cartridge. Substrate was printed upon with the HP DeskJet 5150 printer or Epson Stylus Photo P50 printer. The printed sample allowed standing at room temperature during which time the ink-jet printed areas gradually rose. On standing, a raised series of image and dots was achieved, which could be readily detected by touch. SEM analysis of the printed substrate has confirmed that the raising effect was achieved and nano-particles were produced.

TABLE 8

| Formulation of Ink 2 and Ink 6 | | |
|---|---|---|
| Wt % | Ink 2 | Ink 6 |
| Water | 70.7 | 68 |
| Humectants | 0.7 | 0.68 |
| Binder | 2.12 | 2.04 |
| Co-solvent | 8.83 | 8.53 |
| Reactive material | 17.66 | 20.47 |

EXAMPLE 9

The formulation of Ink1, Ink2, Ink3, Ink4, Ink5, and Ink 6, which were prepared according to Table 1 to Table 8 may comprise of colourant. Colourants used in the ink-jet inks can be dyes or pigments or a combination thereof to produce 3D colourfull ink-jet printing, the percentage of colourant may be varied in the range of 2 to 5% upon the total weight of the mixture.

It is understood that the above description and drawings are illustrative of the present invention and that changes may be made in materials, ink dispensing and thermographic fixing equipment without departing from the scope of the present invention as defined in the following claims.

What is claimed:

1. A method for printing raised text and/or graphics on a single sheet of substrate;

wherein said method is carried out on a home-based and/or office based ink jet printer;

wherein said method comprises steps of:

a controlled amount of two or more reactive materials; each prepared with different formulations, and comprising water soluble metal salts having very low viscosity of less than 10 centipoise, preferably in a range of 1.9 to 3.5 Cps; from at least two common cartridges attached to a single print head are sprayed simultaneously on said substrate combining and mixing with each other;

wherein said controlled amount produces a new nano particle mixture during a chemical reaction; wherein all the steps above including preparation, spraying and mixing of said reactive materials are carried out in room temperature, and wherein said chemical reaction gradually creates a raised printed area of less than 10 microns when left stand alone; wherein a content of said reactive materials in said prepared inks is more than 5%, preferably from 5 to 25% and more preferably form 10 to 25% by weight of total weight of said prepared inks.

2. A method for printing raised text and/or graphics on a single sheet of substrate;

wherein said method is carried out on a home-based and/or office based ink jet printer;

wherein said method comprises steps of:

a controlled amount of a first reactive material; is jetted from a single nozzle of a print head of said ink jet printer on a single sheet of substrate, creating an image/or text in a printed area and wherein a second reactive material comprising a different formulation and concentration than said first reactive material is jetted on said printed area; wherein each of said first and second reactive material comprising water soluble metal salts having very low viscosity of less than 10 centipoise, preferably in a range of 1.9 to 3.5 Cps; and wherein said first and second reactive material are stored and jetted from different cartridges of said ink jet printer; wherein said second reactive material combines and mixes with said first reactive material via a chemical reaction is room temperature; wherein said controlled amount produces a new nano particle mixture during a chemical reaction; and wherein said chemical reaction gradually raises said printed area to less than 10 microns when left stand alone in room temperature.

3. The method of claim 2, wherein said jetting of said controlled amount is in accordance with instructions from a software controlled computer means, creating a programmed printed pattern on said single sheet of substrate; wherein said reactive materials react with each other on said single sheet of substrate.

4. The method of claim 3, wherein a step of creating said raised printed area is only generated via a chemical reaction and does not utilizes any of evaporation drying, freezing of ejected materials, electromagnetic radiation (UV or IR), precipitation reaction, printing of catalysts or polymerization initiator and/or any heating procedures known.

5. The method of claim 4, wherein at least one of first or second reactive materials is substantially colourless liquid and wherein the other one of said first or second reactive material comprises colourant; wherein said colourant comprises dyes and/or pigments and/or combination thereof.

6. The method of claim 5, wherein said reactive materials comprise metal sulphates, metal phosphates, metal acetate, metal citrate, and metal chlorides.

7. The method of claim 6, wherein said raised printed area is Braille, security, packaging, medical function, advertising purposes and printing of warning signs, wall-paper, electronic and ceramic.

8. The method of claim 7, wherein the step of creating said raised printed area comprises raised and non-raised portions, wherein said raised and non-raised portions are printed simultaneously.

9. The method of claim 8, wherein height of said raised printed area is more than 0.1 mm preferably varies between 0.1 to 0.7 mm.

10. A printing system comprising a home-based and/or office based ink jet printer;

wherein said ink jet printer comprises preferably one print head and, multiple common ink cartridges; wherein said ink jet printer is attached to a controlling computer means having software instructions loaded therein; wherein two or more fluids, prepared and stored in each of said common ink jet cartridges; wherein each of said prepared inks having different formulations, comprising different reactive materials wherein said reactive materials comprise water soluble metal salts having very low viscosity of less than 10 centipoise, preferable in a range of 1.9 to 3.5 Cps; wherein at least one of said multiple common ink cartridges comprises common ink jet printer colorants; wherein a controlled amount of said reactive materials with variety of concentrations from said common multiple cartridges, are sprayed by a single nozzle of said ink jet printer simultaneously, in accordance with instructions from said software controlled computer means, on said single sheet of substrate in different configurations; creating a mixture of said reactive materials and therefore a printed area, wherein said mixture allowed standing in room temperature produces nano-particles wherein said printed area gradually rises to less than 10 microns and displays a raising effect, readily detected by touch; wherein said controlled amount of said reactive materials can be sprayed on said substrate once or several times as needed.

11. The printing system of claim 10, wherein chemical reactions in said mixture gradually produces new nano particles hence creating said raising effect.

12. The printing system of claim 11, wherein said mixture forms a raised three dimensional (3D) text and/or image.

13. The printing system of claim 12, wherein said system is a low cost system and wherein said 3D text or image is raised Braille printed text or security, packaging, medical function, advertising purposes and printing of warning signs, wall-paper, electronic and ceramic.

14. The printing system of claim 13, wherein said reactive materials comprise of water based inks comprises de-ionized water as solvent, and wherein water content of said prepared inks are preferably 40% or more by weight of a total weight of said prepared ink having very low viscosity; applicable to any type of said ink jet printers and reduces changes in said viscosity with temperature.

15. The printing system of claim 14, wherein said raised 3D text and/or image is only generated by said chemical reaction and without use of all or any of evaporation drying, freezing, electromagnetic radiation (UV or IR), printing of reagents, precipitation reaction, printing of catalysts or polymerization initiator and/or any heating techniques known.

16. The printing system of claim 15, wherein said metal salts comprise any of metal sulphates, metal phosphates, metal acetate, metal citrate, and metal chlorides.

17. The printing system of claim 16, wherein a content of said reactive materials in said prepared inks is more than 5%, preferably from 5 to 25% and more preferably form 10 to 25% by weight of total weight of said prepared inks.

18. The printing system of claim 17, wherein said prepared inks further comprises other additives such as a dispersant, a surface active agent, a viscosity modifier, a surface tension modifier, buffering agents, anti-mold agents, pH adjustment agent, anti rusting agent and light stabilizers; wherein said PH adjuster comprises Triethylamine, triethanolamine, NaOH, KOH, acetic acid, disodium hydrogen phosphate, HCI and wherein said prepared inks comprise a PH of 7 to 7.5.

19. The printing system of claim 18, wherein said prepared inks further comprising binders, such as polyvinyl butyral, poly vinyl chloride, vinyl resin, vinyl chloride-vinyl acetate copolymer resins, cellulose type resin, polyamide resins, polyurethane resins, epoxy resin, rosin ester resins.

* * * * *